United States Patent [19]

MacDonald

[11] 4,438,595

[45] Mar. 27, 1984

[54] PLUG DOOR ASSEMBLY

[75] Inventor: John A. MacDonald, Beaconsfield, Canada

[73] Assignee: Railtech Ltd., Canada

[21] Appl. No.: 498,037

[22] Filed: May 31, 1983

Related U.S. Application Data

[63] Continuation-in-part of Ser. No. 156,631, Jun. 5, 1980.

[30] Foreign Application Priority Data

Apr. 2, 1980 [CA] Canada ..... 349,055

[51] Int. Cl.[3] ..... E05D 15/10

[52] U.S. Cl. ..... 49/219; 49/449

[58] Field of Search ..... 49/278, 219, 220, 218, 49/449

[56] References Cited

U.S. PATENT DOCUMENTS

| | | | |
|---|---|---|---|
| 814,722 | 6/1906 | Ceyer et al. . | |
| 1,117,798 | 11/1914 | Cutler | 49/219 |
| 2,045,154 | 6/1936 | Lindeman | 49/219 |
| 2,204,753 | 6/1940 | Dwyer | 49/218 X |
| 2,926,399 | 3/1960 | Ramnnas | 49/278 X |
| 2,997,752 | 8/1961 | Henrikson et al. | 49/219 X |
| 3,386,204 | 6/1968 | Obata | 49/278 X |

FOREIGN PATENT DOCUMENTS

| | | | |
|---|---|---|---|
| 483612 | 5/1952 | Canada | 49/218 |
| 961949 | 4/1957 | Fed. Rep. of Germany | 49/218 |

*Primary Examiner*—Kenneth Downey

*Attorney, Agent, or Firm*—Thomas J. Greer, Jr.

[57] ABSTRACT

A plug door assembly for use in closing an opening in a wall. The assembly includes a door and rail means adapted to be mounted on the wall for use in longitudinally moving the door between an open position alongside the opening and an intermediate position opposite the opening. Mounting means movably mount the door on the rail means. The mounting means include means for laterally moving the door between the intermediate position and a closed position within the opening, and means for locking the door in the closed position with cooperating locking means on the wall.

4 Claims, 16 Drawing Figures

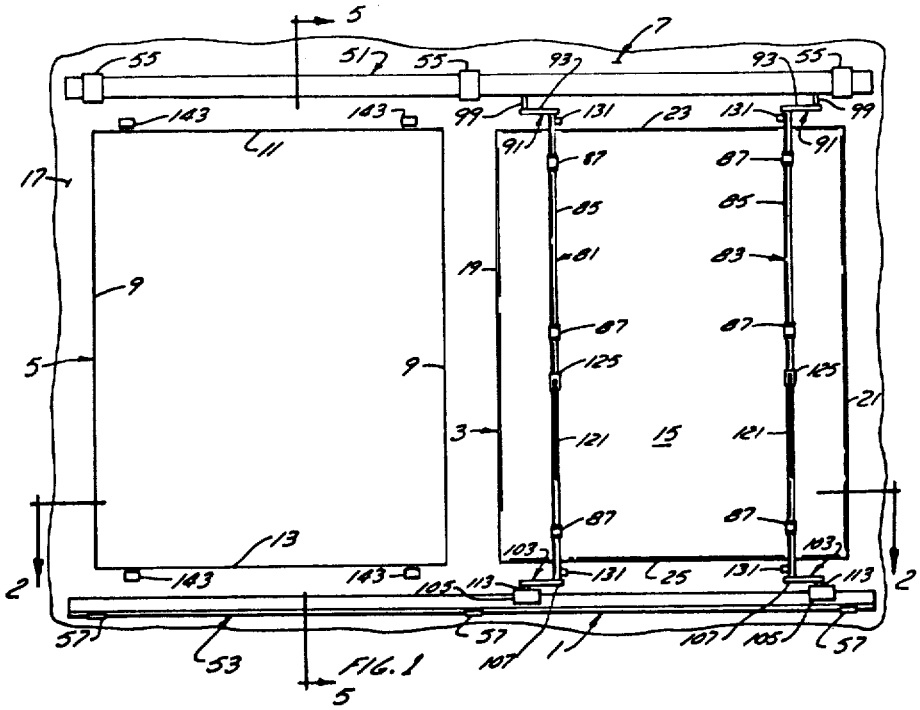
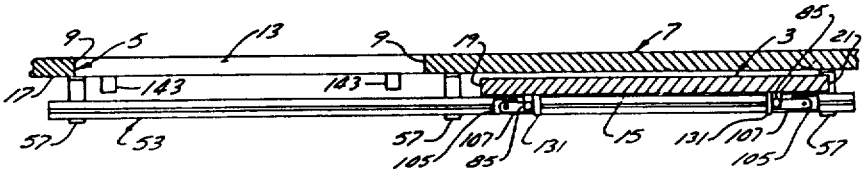
FIG. 2
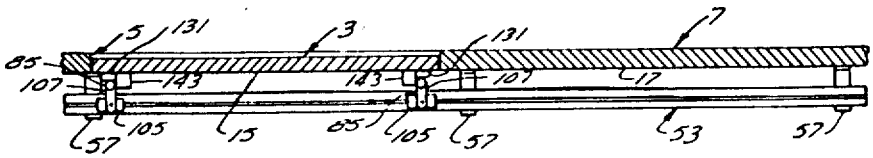
FIG. 3

13
228
224
299
291
285
212
222
234
230
210
216
12
251
242
226
203
220
287

PLUG DOOR ASSEMBLY

CROSS-REFERENCE TO RELATED APPLICATION

This application is a continuation-in-part of United States application Ser. No. 156,631, filed June 5, 1980.

BACKGROUND OF THE INVENTION

1. Field of the Invention

This invention is directed toward an improved door assembly.

The invention is more particularly directed toward an improved plug door assembly.

2. Description of the Prior Art

Plug doors, generally employed on railway cars, are well known. The plug door is mounted on horizontal rails for longitudinal sliding movement between an open position, where it is located alongside an opening in the wall of a railway car and adjacent the wall, and an intermediate position where it overlies the opening. Means are provided for moving the door laterally between the intermediate position and a closed position where it lies within the opening, generally flush with the wall. In the closed position, the door is "plugged" into the opening.

A pair of vertical crankshafts usually mount the door to the rails. The crankshafts are rotatably mounted on the outer face of the door and extend past the upper and lower ends of the door to be fastened to guide means longitudinally movable but laterally immovable on the rails. Each crankshaft has a horizontal crank arm on the upper and lower portion of its length between the door and the rails. Rotation of the crankshafts will laterally move the attached door, via the crank arms, between the intermediate and closed positions.

Separate means are usually provided for locking the door in the closed position. Canadian Pat. No. 393,756, issued Jan. 7, 1941, Dwyer, by way of example, shows such a typical arrangement. The resulting structure is quite complicated, however, requiring as it does separate mechanisms to both move the door laterally of the rails, and to lock it. In addition, with good door seals, it is often very difficult to open the tight-fitting door.

It is known that the door moving mechanism and the locking mechanism can be combined in an attempt to simplify the structure. Such a structure is shown in Canadian Pat. No. 815,299, issued June 17, 1969, Soddy et al. This patented structure, however, requires modification of the door frame to accommodate the locking means and thus does not really simplify the structure, and the difficulty encountered in opening tight-fitting doors remains.

SUMMARY OF THE INVENTION

It is the purpose of the present invention to provide an improved plug door assembly which simply combines the mechanisms for laterally moving the door and for locking the door. It is a further purpose of the present invention to provide an improved plug door assembly having means which assist in opening the door. In accordance with the present invention, these assisting means are preferably combined with the door lateral moving and locking means.

In the present invention, locking bolts are mounted directly on the crankshafts used to laterally move the door. The locking bolts are mounted tangentially on the shafts adjacent the crank arms. The locking bolts cooperate with keepers mounted directly on the outer face of the wall adjacent the opening closed by the door. Rotation of the crankshafts in either direction to move the door laterally in or out of the opening will also move the lock bolts into or out of the keepers to lock or unlock the door. Preferably, the rotatable lock bolts are provided with cam means to assist in "cracking open" the door during initial lateral opening movement.

The improved assembly is simple both in construction and operation. In addition, installation of the assembly does not require special modifications to the existing door frame.

The invention is particularly directed toward a door assembly having a door for closing an opening in a wall, and rail means adapted to be mounted on the wall over the opening for use in longitudinally moving the door between an open position alongside the opening and adjacent the wall, and an intermediate position opposite the opening. Mounting means movably mount the door on the rail means. The mounting means include crankshafts on the door for laterally moving the door between the intermediate position and a closed position within the opening and a low friction elongated carriage member slidably mounted on the rail means. The crankshafts are pivotally mounted in journals provided in the carriage, with one of the journals being in the form of an elongated slot such that the crankshaft received by the slot can travel along the longitudinal axis of the elongated carriage relative to the other crankshaft or shafts. Locking means on the mounting means cooperate with locking means on the wall to lock the door in the closed position.

The locking means on the mounting means include cam means to assist in initially moving the door from the closed position to the intermediate position.

BRIEF DESCRIPTION OF THE DRAWINGS

The invention will now be described in detail having reference to the accompanying drawings, in which:

FIG. 1 is an elevation view of the door assembly with the door in the open position;

FIG. 2 is a cross-section view taken along line 2—2 of FIG. 1;

FIG. 3 is a cross-section view similar to FIG. 2 but with the door in the closed position;

Figure 8:
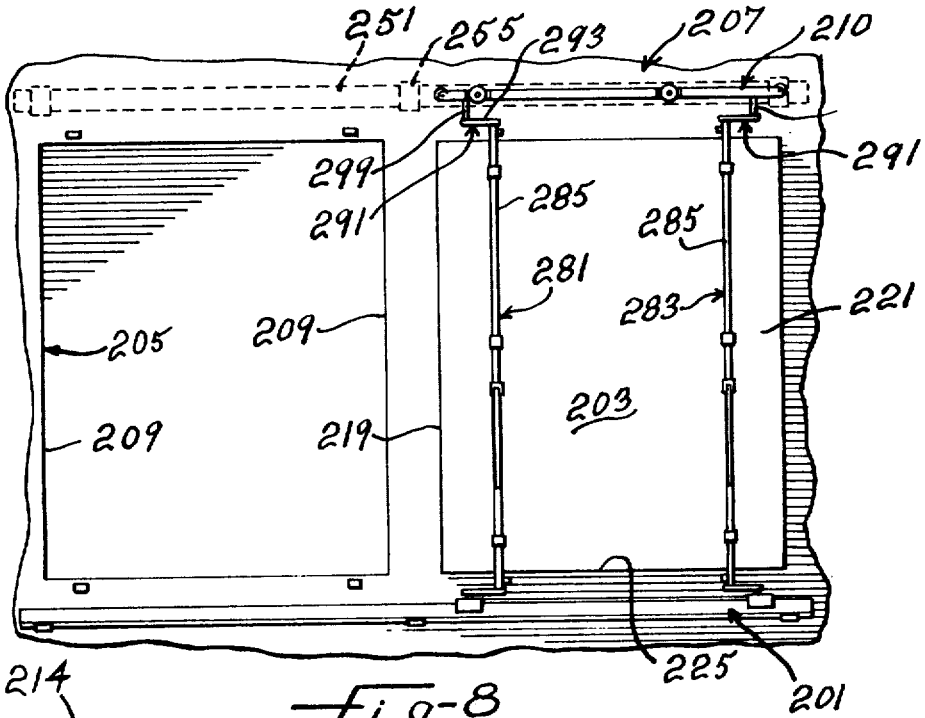
Figure 9:
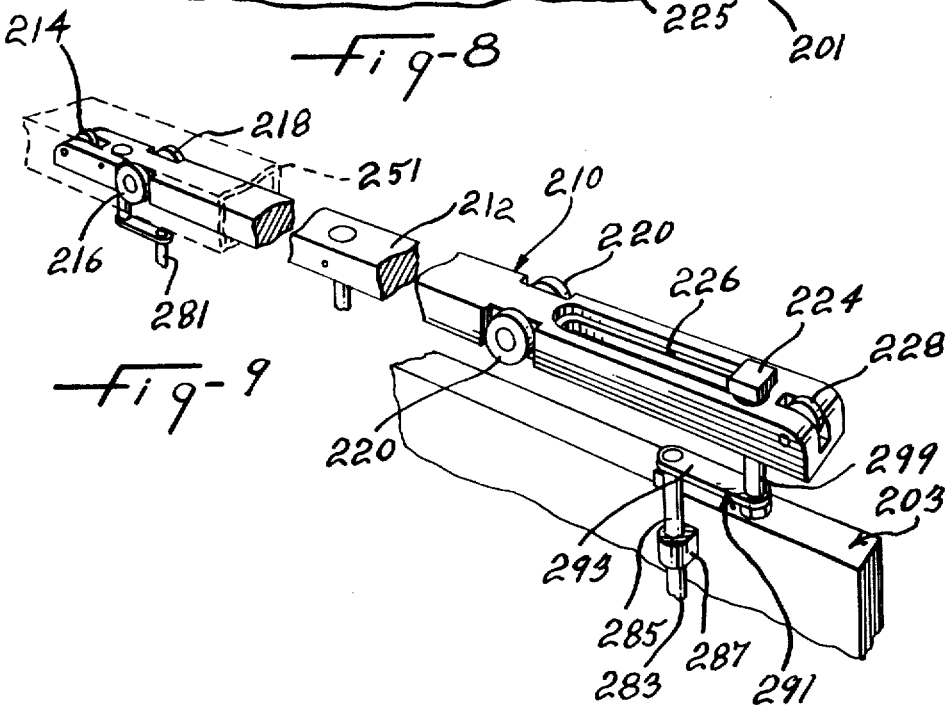
Figures 10, 11, 14:
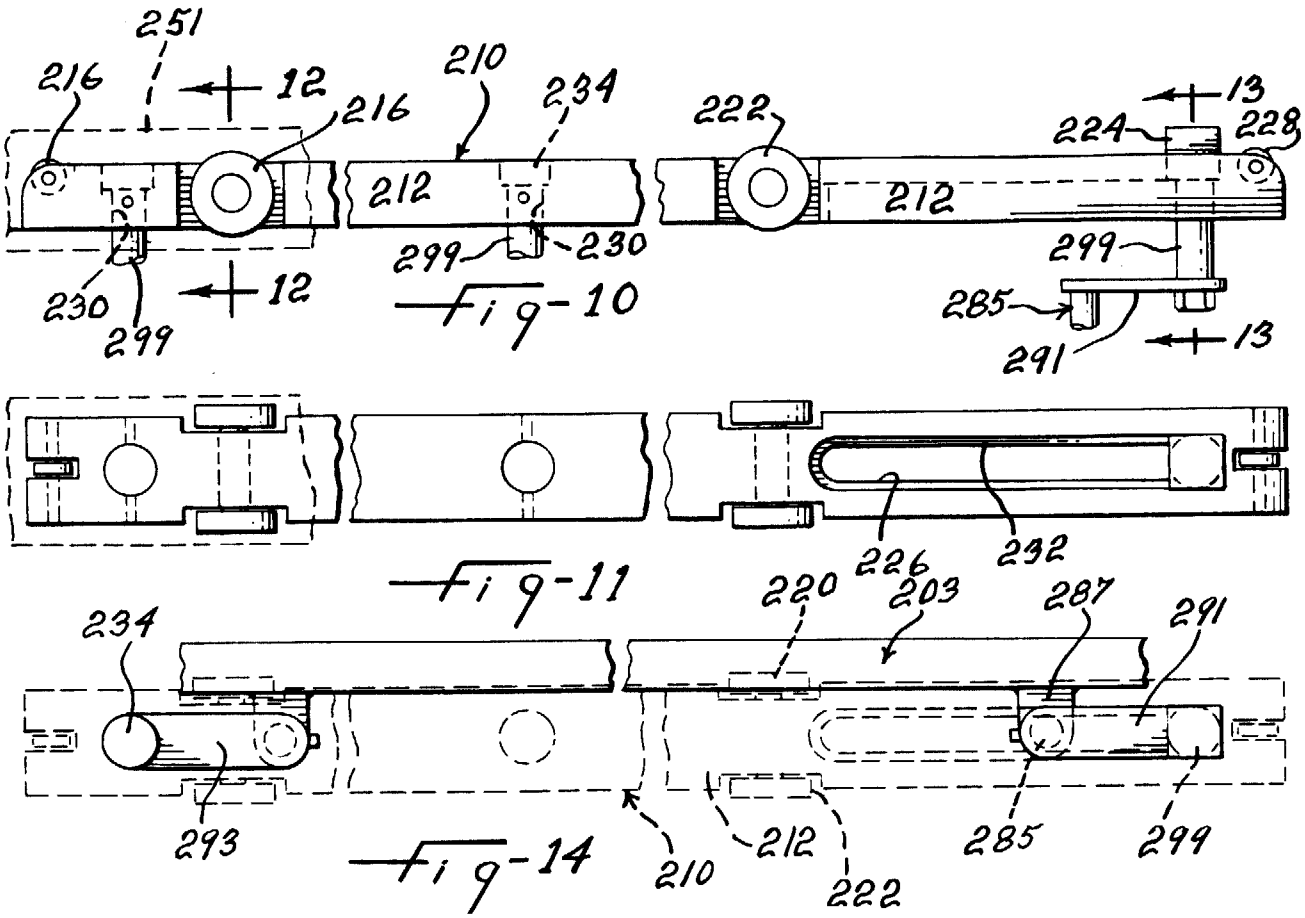
Figure 13:
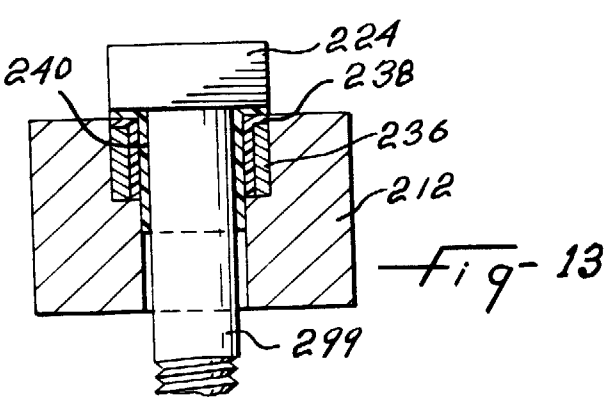
Figure 12:
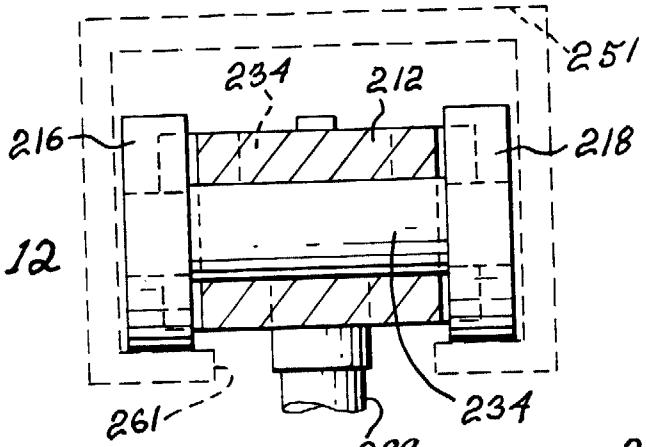
Figure 15:
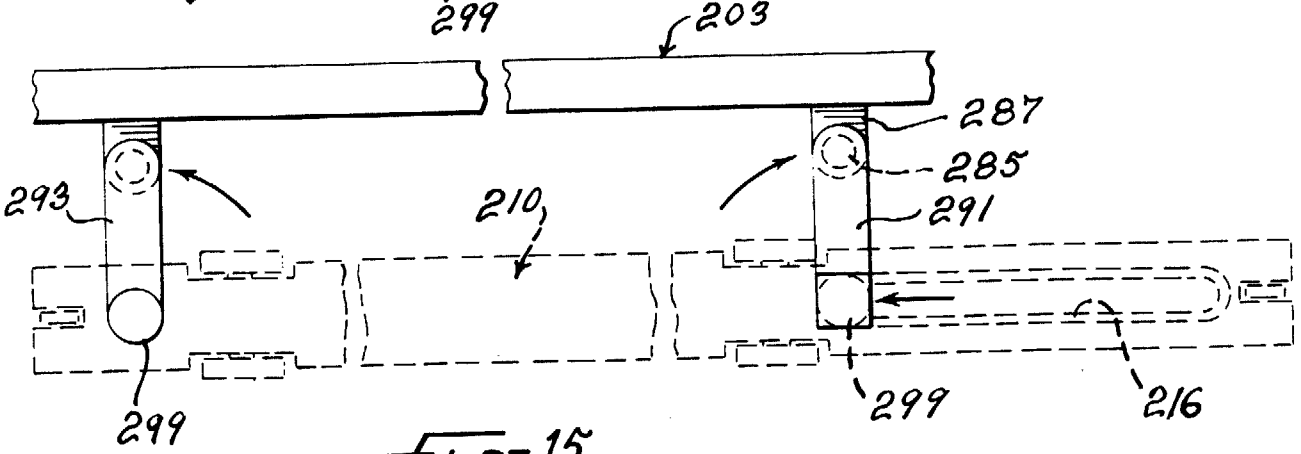

FIGS. *7a* and *7b* are detailed cross-sectional views of the locking means in two different positions;

FIG. 8 is an elevation view of another embodiment of the door assembly with the door in an open position similar to FIG. 1:

FIG. 9 is a perspective view of a detail of the embodiment of the door assembly shown in FIG. 8;

FIG. 10 is a side elevation of the element shown in FIG. 9;

FIG. 11 is a top plan view thereof;

FIG. 12 is a vertical cross-section taken along line 12—12 of FIG. 10;

FIG. 13 is a vertical cross-section taken along line 13—13 of FIG. 10;

FIG. 14 is a fragmentary top plan view of a detail of the embodiment shown in FIG. 8 with one element shown in dotted lines; and FIG. 15 is a top plan view, similar to FIG. 14, but showing the various elements in a different operating position.

DESCRIPTION OF THE PREFERRED EMBODIMENTS

The door assembly 1 of the present invention, shown in FIG. 1, includes a door 3 which closes an opening 5 in a wall 7. The wall 7 preferably comprises a side wall in a railway boxcar but the wall can also form part of a building, a shipping container, or other similar structures. The opening 5 in the wall 7 is square or rectangular in shape and is defined by vertical side edges 9 and horizontal top and bottom edges 11, 13.

Figures 4, 5, 6, 7A, 7B:
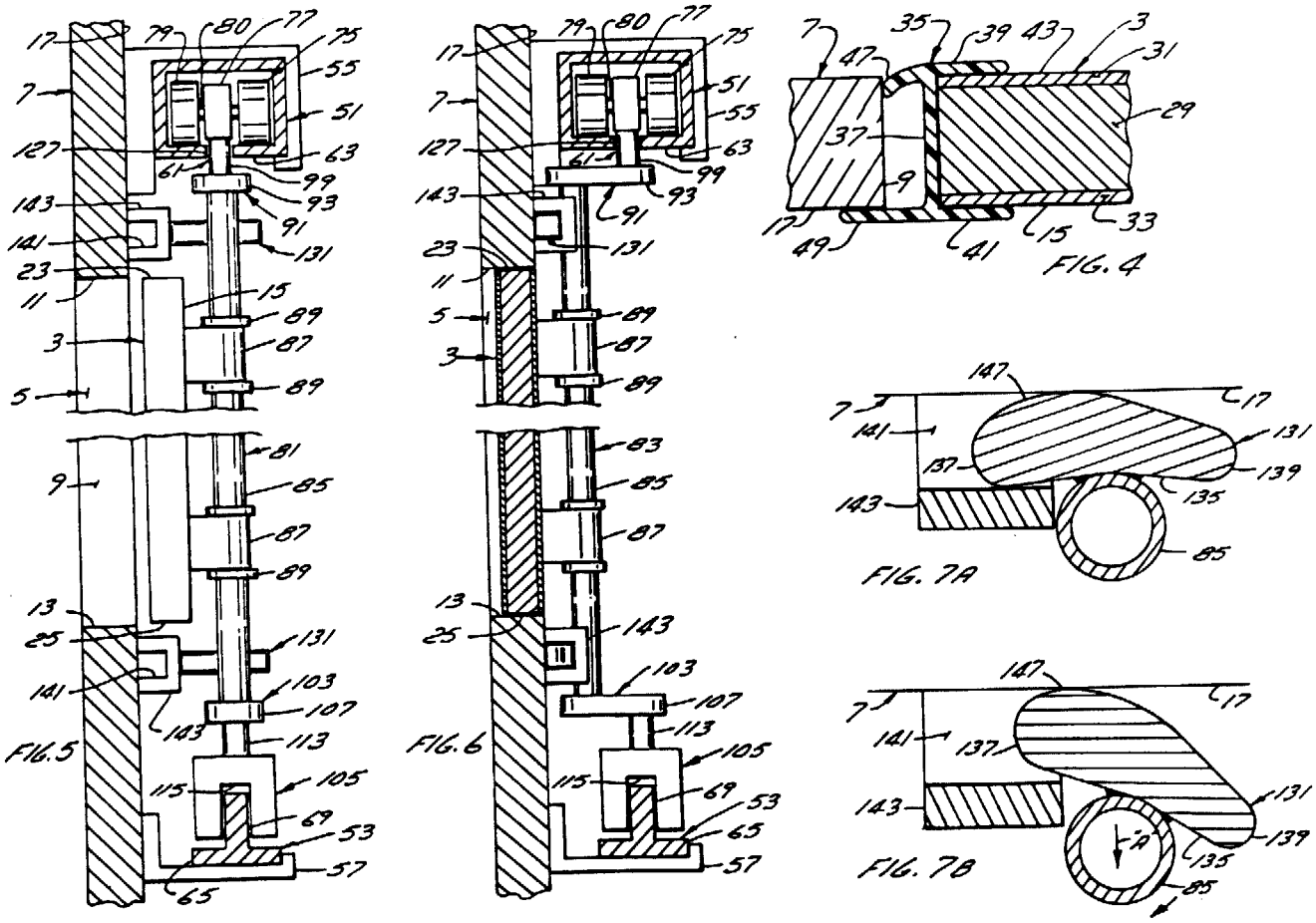
FIG. 4 is a detail cross-section view of the door showing the door construction and door seal.
FIG. 5 is a cross-section view taken along line 5—5 of FIG. 1.
FIG. 6 is a view similar to FIG. 5 but with the door closed.

The door 3 is shaped and sized to fit within the opening 5 to close it with the outer surface 15 of the door generally flush with the outer surface 17 of wall 7 as shown in FIG. 3. The door 3 has vertical sides 19, 21, and horizontal top and bottom ends 23, 25. The door 3 preferably comprises a composite structure with a thick central core 29, which can be made from plywood, and with thin outer layers 31, 33, which can be made from metal, adhesively secured to the core 29 as shown in FIG. 4. A double seal 35 is fixed about the edge of the door. The seal 35 includes a U-shaped portion having a base 37, and legs 39, 41 extending from the ends of the base. The U-shaped portion of the seal is adhesively fastened over the edge of the door with inner leg 39 fastened to the inner surface 43 of the door and with outer leg 41 fastened to the outer surface 15 of the door. A first short inner seal flap 47 extends from one end of base 37 in the opposite direction to the one leg 39. A second longer outer seal flap 49 extends from the other end of base 37 in the direction opposite to the other outer leg 41. The flaps 47, 49 are curved slightly toward one another. When the door 3 closes opening 5, the short inner flap 47 contacts the edges 9, 11, 13 of the opening 5 and the longer outer flap 43 bears against the outer surface 17 of the wall 7 adjacent the opening 5 to provide a double seal. The seal 35 is well known.

The door assembly 1 includes rail means adapted to be mounted on the wall 7 for use in longitudinally moving the door 3 between an open position alongside the opening 5, and adjacent the wall 7, and an intermediate position opposite the opening. Preferably, the rail means comprise parallel upper and lower rails 51, 53 as shown in FIG. 1. The upper rail 51 is adapted to be fixed to the outer surface 17 of wall 7 by suitable brackets 55. The upper rail 51 extends generally parallel to the upper edge 11 of opening 5 and is slightly spaced above it. The bottom rail 53 is also adapted to be fixed to the outer surface 17 of wall 7 by suitable brackets 57, and it extends parallel to the bottom edge 13 of opening 5 and is slightly spaced below it. Both rails 51, 53 extend across the width of the opening 5 and project past one side 9 of the opening 5 a distance equal to slightly more than the width of the opening.

The upper rail 51 preferably comprises a tubular member having a generally square, cross-sectional shape with a longitudinal slot 61 in the center of the bottom wall 63 of the member as shown in FIG. 5. The lower rail 53 preferably comprises a member having an inverted, T-shaped cross-section with a flat, plate-like base 65 and a rib 69 projecting up from the center of the base 65.

Means are provided for movably mounting the door 3 on the rail means. Preferably, the door 3 is suspended from the upper rail 51 and is guided along the bottom rail 53. More particularly, the door 3 is suspended from a pair of trolleys 75 forming part of the mounting means, the trolleys running within the upper rail 51. Each trolley comprises a body member 77 carrying a pair of wheels 79 at each end mounted on axles 80. The wheels 79 run on the bottom wall 63 of the rail 51, straddling slot 61 as shown in FIG. 5.

The mounting means include a pair of crankshafts 81, 83 rotatably mounted on the door 3. The crankshafts 81, 83 suspend the door 3 from the upper rail 51 and on the lower rail 53, and also are used to move the door laterally relative to the rails. One shaft 81 is adjacent or near the vertical side 19 of door 3; the other shaft 83 is adjacent or near the vertical side 21 of the door 3. Each crankshaft 81, 83 includes a straight vertical rod 85 rotatably mounted by brackets 87 on the outer face 45 of the door 3. Stop members 89 on the rods 85 rest against both sides of brackets 87 to retain the rods 85 in position on the door 3 and vice-versa. Each rod 85 projects a short distance past the top and bottom ends 23, 25 of the door.

Crank means 91 connect the upper end of each crankshaft rod 85 to a trolley 75. The crank means 91 preferably comprises a horizontal crank arm 93 fixed at one end to the top end of vertical rod 85. The other end of the crank arm 93 is fixed to the bottom end of a short vertical pin 99 which passes up through slot 61 in upper rail 51 to rotatably connect with the body 77 of trolley 75 between the wheel pairs 79. Alternatively, the crank means 91 can comprise an integral portion of rod 85 bent twice in its upper portion to provide a short horizontal run, equivalent to crank arm 93, and a short vertical run, equivalent to pin 99.

Crank means 103 connect the lower end of each crankshaft rod 85 to a guide block 105 slidably mounted on bottom rail 53. The bottom crank means 103 also preferably comprises a horizontal crank arm 107 fixed at one end to the bottom end of rod 85. The other end of the crank arm 107 is fixed to the top end of a vertical pin 113 rotatably mounted to the guide block 105. The guide blocks 105 comprise channel-shaped members having a slot 115 receiving the rib 69 of the bottom rail 53. The bottom crank means 103 could also be formed from an integral portion of rod 85 bent to provide a short horizontal section equivalent to crank arm 107 and a short vertical section, equivalent to pin 113.

In operating handle 121 is mounted on each crankshaft 81, 83 as shown in FIG. 1. Each handle 121 is pivotally mounted by a pin (not shown) to a bracket 125 fixed to rod 85 generally midway between its ends. The handles 121 normally hang down in a position generally parallel to rods 85. To use the handles 121, they are pivoted up about the pins to extend perpendicular to the rods.

With the door 3 lying within the opening 5 in its closed position, flush with the wall 7, the crank arms 93, 107 extend generally perpendicular to the door. To open the door, the operating handles 121 are moved one at a time to be perpendicular to rod 85, and then moved through about 90° from a position generally parallel to the door to a position generally perpendicular to the door. This movement of the handles will rotate the crankshafts 81, 83 through about 90° also thereby moving the door laterally out of the opening. The crankshafts 81, 83 rotate about the axis of the pins 99, 113 with pins 99 bearing against the inner edge 127 of the slot 61. Once the door is moved laterally out of the opening to an intermediate position opposite the opening by the rotation of the crankshafts 81, 83, it can then be moved longitudinally, using trolleys 75 and sliders 105, along the rails 51, 53 to an open position adjacent the opening.

The door assembly 1 includes means for locking the door 3 in place within the opening 5. In accordance with the present invention, the locking means are combined with the means for mounting the door. More particularly, the locking means includes lock bolts 131 mounted on the crankshafts 81, 83. A pair of lock bolt members 131 are mounted on each crankshaft 81, 83, with one member 131 fixed to rod 85 just above the upper edge 23 of the door, adjacent the top crank arm 93 and with one member 131 fixed to rod 85 just below the bottom edge 25 of the door adjacent the bottom crank arm 107. Each lock bolt 131 can comprise a fingershaped member fastened by welding or other suitable means along one side 135, between its ends 137, 139, to the rod 85, the lock bolt extending both perpendicular to the rod 85 and tangential to it as shown in FIG. 7*a*.

With the door 3 closing the opening 5, the lock bolts 131 lie adjacent the wall 7 with their locking end 137 inserted in the slot 141 of a keeper 143 fastened to the wall 7 adjacent the rods 85 as shown in FIG. 7*a*. The keepers 143 are located on the wall 7 adjacent the crankshafts 81, 83, and adjacent the opening 5.

Initial rotation of the crankshafts 81, 83 by handles 121 to move the door 3 laterally out of the opening 5 will simultaneously rotate the lock bolts 131 out of the keepers 143 to unlock the door 3. Similarly, the final stages of rotation of the crankshafts 81, 83 in moving the door 3 into the opening 5 will move the lock bolts 131 into the keepers 143 to lock the door in place.

Preferably, the door assembly is provided with cam means for use in initially moving the door out of the opening. The cam means help "crack" the door from its tight-sealing fit in the opening. The cam means preferably comprise a cam surface 147 on each lock bolt 131, opposite its one side 135. The cam surface 147 is located to cooperate with the wall 7 just after the initial rotational movement of the crankshafts 81, 83 to cam the shafts 81, 83, and thus the attached door, laterally outwardly from the wall to crack the seal as shown in FIG. 7*b* by arrow "A".

In closing the door, the cam surface 147 clears the wall 7 just prior to the final rotation of the cam shafts 81, 83. The final rotation of the cam shafts 81, 83 then forces the end 137 of the lock bolts 131 tight against the keepers 143 within slot 141 to force the door tight within the opening.

Stop means (not shown) are provided on the rails 51, 53 to stop longitudinal movement of the door at the intermediate position opposite the opening as the door moves from its open to its closed position. The stop means ensure that the lock bolts will cooperate with the keepers. Stop means also are provided to retain the door on the rails as it moves to its open position.

FIGS. 8 through 15 show another embodiment of the present invention with an important feature in the form of an elongated sliding carriage 210 sliding in the upper rail 251.

In FIG. 8, for instance, the elements similar to those shown in FIG. 1 have been raised by 200.

The car includes a wall 207 with an opening 205 and a door 203. An upper guide rail 251 and a lower guide rail 201 are provided on the wall 207 and extend parallel to each other over and below the opening 205 respectively. The door 203 is provided with a pair of crankshafts 281 and 283, each including crankshaft rods 285 with crank means 291 connecting the crank rods 285 to the carriage 210. The crank means 291 includes a horizontal crank arm 293 fixed at one end to the top of the vertical rod 285, and the other end of the crank arm 293 is fixed to a vertical pin 299 having an enlarged head 234 adapted to sit in a shouldered journal 230. The pin 299 can rotate about its axis in the journal 230.

The pin 299 on the end of the crank rod 283 is, in this case, provided with a cap 224 which is larger than the slot 226 in the beam 212 of carriage 210, as will be described later. Any number of crankshafts could be mounted to the carriage 210. In the present case, only two shafts are illustrated, namely, crankshafts 281 and 283.

The carriage 210 has a square cross-section and is adapted to glide through the box-shaped upper guide rail 251, including a longitudinal bottom elongated opening 261, as shown in FIG. 12. The carriage 210 includes at each end thereof pairs of wheels 216, 218 and 220, 222. The wheels are provided in recesses in the beam 212 and are adapted to support the carriage in its travel within the guide rail 251. The ends of the carriage 210 are rounded and include wheels 214 and 228, one at each end thereof. These wheels prevent the carriage 210 from jamming in the rail when different forces are applied to the carriage.

The carriage 210 includes an elongated slot 226 at one end thereof through which the pin 299 on crankshaft 283 is journaled and is allowed to travel relative to the pin 299 and crankshaft 281. The slot 226 has a shoulder 232 adapted to receive bearing sleeves 236, 238 and 240 on the pin 299 below the cap 224.

In operation, the carriage provides a better distribution of the weight of the door 203 and prevents jamming, to which individual trolleys are susceptible. If it is required to open or close the doors, the crankshafts 281 and 283 may operate in opposite directions as shown in these drawings, particularly FIGS. 14 and 15, thereby providing for a more direct closing of the door 203 into the opening.

I claim:

1. A door assembly comprising a door for closing an opening in a wall, first rail means mounted on the wall over the opening for use in longitudinally moving the door between an open position alongside the opening and adjacent the wall and an intermediate position opposite the opening; mounting means movably mounting the door on the first rail means; the mounting means including at least a pair of vertical crankshafts rotatably mounted on the outer face of the door, the crankshafts extending past the upper and lower ends of the door; a low friction elongated carriage member slidably mounted on the rail means over the opening, the [crankshaft]crankshafts being pivotally mounted in spaced journals provided in the carriage, one of the journals being in the form of an elongated slot such that the crankshaft received by the slot can travel along the longitudinal axis of the elongated carriage relative to the other crankshaft or shafts; second rail means provided under the opening on the wall; and guide means on the lower ends of the crankshafts cooperating with said second rail means under the opening for guiding the door; said mounting means including means for laterally moving the door between the intermediate position opposite the opening and a closed position within the opening and a closed position within the opening in the plane of the wall; and locking means on the mounting means for cooperating with locking means on the wall to lock the door within the opening.

2. A door assembly as defined in claim 1, wherein the first rail means is in the form of a closed box with an elongated bottom slot defining inwardly extending flanges, the carriage being in the form of an elongated beam having wheels, the wheels adapted to roll along the inwardly extending flanges of the first rail means.

3. A door assembly as claimed in claim 1, wherein the locking means comprise lock bolts fixed tangentially to the crankshafts and extending perpendicular to the crankshafts, the lock bolts cooperating with keepers fixed to the outside surface of the wall adjacent the crankshafts and the opening.

4. A door assembly as claimed in claim 3, including a cam surface on the lock bolts cooperating with the wall when the crankshafts are rotated to assist in moving the door out of the opening.

* * * * *